US009986765B2

(12) United States Patent
Batista

(10) Patent No.: US 9,986,765 B2
(45) Date of Patent: Jun. 5, 2018

(54) CONTAINER HAVING A HEATER FOR AN AEROSOL-GENERATING DEVICE, AND AEROSOL-GENERATING DEVICE

(71) Applicant: Philip Morris Products S.A., Neuchatel (CH)

(72) Inventor: Rui Nuno Batista, Morges (CH)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 0 days. days.

(21) Appl. No.: 15/302,383

(22) PCT Filed: Apr. 24, 2015

(86) PCT No.: PCT/EP2015/058910

§ 371 (c)(1),
(2) Date: Oct. 6, 2016

(87) PCT Pub. No.: WO2015/165814

PCT Pub. Date: Nov. 5, 2015

(65) Prior Publication Data

US 2017/0035116 A1 Feb. 9, 2017

(30) Foreign Application Priority Data

Apr. 30, 2014 (EP) ..... 14166739

(51) Int. Cl.
*A24F 47/00* (2006.01)
*B65D 47/36* (2006.01)
*H05B 1/02* (2006.01)

(52) U.S. Cl.
CPC ..... *A24F 47/008* (2013.01); *B65D 47/36* (2013.01); *H05B 1/0244* (2013.01); *H05B 2203/021* (2013.01)

(58) Field of Classification Search
CPC ..... A24F 47/008; B65D 47/36; H05B 1/0244
See application file for complete search history.

(56) References Cited

U.S. PATENT DOCUMENTS

2010/0024834 A1 2/2010 Oglesby et al.
2012/0247494 A1 10/2012 Oglesby et al.
(Continued)

FOREIGN PATENT DOCUMENTS

WO WO 2009/079641 A2 6/2009
WO 2013/128176 A1 9/2013
WO 2013/159245 A1 10/2013

OTHER PUBLICATIONS

International Search Report and Written Opinion dated Jul. 6, 2015 in PCT/EP15/058910 Filed Apr. 24, 2015.

*Primary Examiner* — Ross Gushi
(74) *Attorney, Agent, or Firm* — Oblon, McClelland, Maier & Neustadt, L.L.P.

(57) ABSTRACT

A container for use in an electrically heated aerosol-generating device is provided, the container including a piercing area, wherein the electrically heated aerosol-generating device has a piercing element configured to pierce the piercing area; a casing; and a cap including the piercing area and a heater, the heater defining a boundary of the piercing area. An electrically heated aerosol-generating device is also provided, including a power supply; a cavity configured to receive a container; electrical contacts connected to the power supply and configured to couple the power supply to the heater of the container through electrical contacts of the container; means for piercing the piercing area of the container when the container is received in the cavity. A method of manufacturing a container including an aerosol-generating substrate is also provided.

15 Claims, 4 Drawing Sheets

(56) References Cited

U.S. PATENT DOCUMENTS

| | | | | |
|---|---|---|---|---|
| 2013/0160765 | A1 | 6/2013 | Liu | |
| 2015/0040929 | A1 | 2/2015 | Hon | |
| 2017/0042244 | A1* | 2/2017 | Batista | A24F 47/008 |

* cited by examiner

CONTAINER HAVING A HEATER FOR AN AEROSOL-GENERATING DEVICE, AND AEROSOL-GENERATING DEVICE

The present invention relates to containers for an aerosol-generating substrate, and to a method of manufacturing such containers. The invention further relates to electrically heated aerosol-generating devices configured for use with the containers.

Aerosol-generating systems comprising containers and an aerosol-generating devices are known. One particular system is disclosed in WO 2009/079641, and comprises a container comprising a shell containing viscous vapourisable material and an aerosol-former, such as propylene glycol. The shell is sealed by a lid which can be penetrated by the aerosol-generating device when the container is inserted therein to allow airflow through the container when in use. The device comprises a heater configured to heat the external surface of the shell to a temperature up to about 200 degrees C., and in one example the external surface of the shell is heated to 170 degrees C. The aerosol-generating device is elongate and has a diameter similar to that of a conventional combustible smoking article (a cigarette) and as such the heater is necessarily very close to the external wall of the device. It has been found that the proximity of the heater to the external wall of the device results in an external temperature of the device housing in the region of the heater of over 90 degrees. At the very least, this can be uncomfortable for the user. In addition, the time to first puff of the device has been found to be up to 30 seconds.

Thus, it would also be desirable to provide such a container which improves the heating of the aerosol-forming substrate.

According to an aspect of the present invention, there is provided a container for an aerosol-generating substrate, the container having a piercing area, for use in an electrically heated aerosol-generating device having a piercing element for piercing the piercing area. The container comprises: a casing; and a cap including the piercing area and a heater, the heater defining the boundary of the piercing area.

Advantageously, providing a heater on the cap, arranged to enable the cap to be pierced, enables heat to be applied more efficiently to the container. Providing the piercing area enables the cap to be pierced to allow a generated aerosol to be released from the container without damaging the heater.

The heater preferably has an interior edge and an exterior edge, wherein the interior edge of the heater defines the boundary of the piercing area. Alternatively, the exterior edge of the heater defines the boundary of the piercing area.

The heater is preferably arranged within an annular portion of the cap. The central portion of the cap is therefore preferably free from the heater, and thus can be pierced without damaging the heater. Arranging the heater in an annular portion of the cap may increase the size of the piercing area. The annular portion is preferably adjacent the external edge of the cap.

The heater is preferably provided in a wave shape within the annular portion of the cap, such that the total length of the heater is greater than the circumferential length of the annular portion. Advantageously, increasing the length of the heater improves the heat transfer from the heater to the aerosol-forming substrate. The wave shape may be a triangular wave, a square wave or a sinusoidal wave.

The heater preferably comprises two electrical contacts, the first electrical contact at a first distance from a edge of the cap, and the second electrical contact at a second distance from an edge of the cap. By providing the electrical contacts in such an arrangement, the container may be placed in an aerosol-generating device in any rotational orientation while still enabling the correct electrical connections to be made.

The casing of the container preferably has a substantially circular cross-sectional shape. By providing a substantially circular cross-sectional shape the container may be more easily inserted into a cavity of an aerosol-generating device. However, any other suitable cross-sectional shape may be provided, such as elliptical.

The material used to form the casing of the container may be metal, preferably aluminium. Alternatively, the material used to form the casing may be polymeric, such as any suitable polymer capable of withstanding the operating temperature of an aerosol-forming device.

The cap is preferably made from a polymer, or a metal, and more preferably is made from aluminium. The cap may be laminated to improve the sealing ability, and in a particularly preferred embodiment is laminated, food grade, anodised aluminium.

The cap may be sealed to the casing of the container using any suitable method, including: adhesive, such as an epoxy adhesive; heat sealing; ultrasonic welding; and laser welding.

The heater preferably comprises at least one electrically resistive track provided on a flexible substrate. Providing the heater on a flexible substrate enables the heater to be applied to the cap more easily, and increases the durability of the heater. In this embodiment, the cap is preferably formed as a laminate comprising the flexible substrate. The laminate preferably further comprises a layer of a piercable foil material, the foil may be a metal, preferably aluminium. Alternatively, the foil may be polymeric.

Preferably, the electrically resistive track is adhered to the flexible substrate using any suitable means.

The electrically resistive track may be any one of: stainless steel, copper; brass platinum; gold; and silver or any other resistive material that may provide a sufficiently high temperature when provided with an electrical current during operation such that a sufficiently dense aerosol is formed.

By providing the heater to the cap on a flexible substrate the manufacturing process may be simplified. The manufacturing process is described in further detail below.

The or each electrical heating element preferably has an elongate cross-sectional profile. Where the aerosol-generating substrate is a liquid, providing the elongate cross-sectional profile increases the volume of liquid in contact with the heater, and thus the heater is more efficient. A conventional heater having a coil of wire as the heating element generally has a circular or oval cross-sectional shape, and a meniscus of liquid may only form at the sides of the wire. In comparison, the elongate cross-sectional profile of the present invention enables a meniscus of liquid to form both at the sides of the heater and on the top surface.

The elongate cross-sectional profile is preferably rectangular. A rectangular cross-sectional shape is easier to manufacture and thus reduces costs.

The electrical resistance of the or each heater is preferably between 0.3 and 4 Ohms. More preferably, the electrical resistance of the or each heater is between 0.5 and 3 Ohms, and more preferably about 1 Ohm. The electrical resistance of the or each heater is preferably at least an order of magnitude, and more preferably at least two orders of magnitude, greater than the electrical resistance of the contact portions. This ensures that the heat generated by passing current through the heater element is localised to the heater. It is advantageous to have a low overall resistance for the heater if the system is powered by a battery. A low resistance, high current system allows for the delivery of high power to the heater. This allows the heater to reach the electrically conductive filaments to a desired temperature quickly.

As used herein, the term "longitudinal" refers to the direction between the proximal end and opposed distal end of the container, and refers to the direction between the proximal, or mouthpiece, end and the distal end of the aerosol-generating device.

The aerosol-forming substrate is preferably a substrate capable of releasing volatile compounds that can form an aerosol. The volatile compounds are released by heating the aerosol-forming substrate.

The aerosol-forming substrate may be solid or liquid or comprise both solid and liquid components. In a preferred embodiment, the aerosol-forming substrate is solid.

The aerosol-forming substrate may comprise nicotine. The nicotine containing aerosol-forming substrate may be a nicotine salt matrix. The aerosol-forming substrate may comprise plant-based material. The aerosol-forming substrate may comprise tobacco, and preferably the tobacco containing material contains volatile tobacco flavour compounds, which are released from the aerosol-forming substrate upon heating. The aerosol-forming substrate may comprise homogenised tobacco material.

The container preferably comprises an aerosol-forming substrate comprising nicotine, wherein in use the aerosol-forming substrate is accessible once the piercing area has been pierced.

The aerosol-forming substrate may alternatively comprise a non-tobacco-containing material. The aerosol-forming substrate may comprise homogenised plant-based material.

Homogenised tobacco material may be formed by agglomerating particulate tobacco. Where present, the homogenised tobacco material may have an aerosol-former content of equal to or greater than 5% on a dry weight basis, and preferably between greater than 5% and 30% by weight on a dry weight basis.

The aerosol-forming substrate may comprise at least one aerosol-former. The aerosol-former may be any suitable known compound or mixture of compounds that, in use, facilitates formation of a dense and stable aerosol and that is substantially resistant to thermal degradation at the operating temperature of the aerosol-generating device. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Particularly preferred aerosol formers are polyhydric alcohols or mixtures thereof, such as triethylene glycol, 1,3-butanediol and, most preferred, glycerine.

The aerosol-forming substrate may comprise other additives and ingredients, such as flavourants.

The aerosol-forming substrate preferably comprises nicotine and at least one aerosol-former. In a particularly preferred embodiment, the aerosol-former is glycerine.

The container is preferably filled with between about 150 mg and about 400 mg of aerosol-forming substrate, more preferably between about 200 mg and about 300 mg of aerosol-forming substrate, and in a preferred embodiment about 250 mg of aerosol-forming substrate.

According to a further aspect of the present invention, there is provided a method of manufacturing a container comprising an aerosol-generating substrate as described herein. The method comprises: providing a web of flexible substrate material; applying a plurality of electrically resistive tracks to the web of flexible substrate material; cutting the web of flexible substrate to form heater elements comprising an electrically resistive track; providing a web of piercable material; applying the heater elements to the web of piercable material; cutting the web of piercable material to form caps for a container; providing containers; filling each container with an aerosol-generating substrate; and sealing each container with a cap comprising the heater.

Preferably, the method further comprises the step of forming each electrically resistive track by at least one of: stamping; printing; etching; deposition with sintering; and deposition without sintering. In a particularly preferred embodiment, the electrically resistive tracks are formed by stamping. Preferably, the tolerance of the dimensions of the electrically resistive track is less than $1/10^{th}$ mm, and preferably the precision is at least 99%.

Preferably, the method comprises applying the formed electrically resistive track on a substantially continuous web of flexible substrate material, the continuous web of substrate material being provided on a bobbin for use in forming the caps for a container. By providing a bobbin of substantially continuous web of flexible substrate material, the process of forming the heater can be separated from the process of forming the cap, thereby improving the efficiency of the manufacturing process.

According to a yet further aspect of the present invention there is provided an electrically heated aerosol-generating device. The device comprises a power supply; a cavity for receiving a container as described herein containing an aerosol-forming substrate; electrical contacts connected to the power supply and configured to couple the power supply to the heater of a container through the electrical contacts of the container; and means for piercing the piercing area of a container when the container is received in the cavity.

By providing such an aerosol-generating device, the efficiency of heating an aerosol-generating substrate, and thus the efficiency of generating an aerosol may be improved because the heater may be provided closer to the aerosol-generating substrate.

The piercing means is preferably a piercing element. The device preferably further comprises a mouthpiece. The mouthpiece comprises: the piercing element; at least one air inlet and at least one air outlet, wherein, the piercing means comprises at least one first conduit extending between the at least one air inlet and a distal end of the piercing element, and at least one second conduit extending between a distal end of the piercing element and the at least one air outlet, such that in use, when a user draws on the mouthpiece, air flows along an airflow pathway extending from the at least one air inlet, through the at least one first conduit, through a portion of the container, through the at least one second conduit and exits the at least one outlet.

The piercing means may be an electrical insulator. As used herein, 'electrical insulator' is a material whose internal electric charges do not flow freely, and therefore very hard to conduct an electric current under the influence of an electric field. Preferably, the electrical insulator has having a resistivity of $1\times10^4$ Ωm or more.

Preferably, the electrical contacts are provided at first and second radial distances from the longitudinal axis of the device to ensure proper connection to the electrical contacts of the heater. In a preferred embodiment, the electrical contacts are substantially continuous rings such that the container may be provided in the cavity in any axial rotation and still enable proper electrical connections to be made. Preferably, the rings are concentric.

In the embodiment comprising a mouthpiece having a piercing element, electrical contacts are provided in the housing of the device, and on the mouthpiece. The electrical contacts on the mouthpiece are preferably rings, and are more preferably concentric rings. The electrical contacts in the housing are preferably provided at first and second radial distances. Thus, the electrical contacts within the mouthpiece are configured to couple the electrical contacts of the container to the electrical contacts of the device provide din the housing.

The power supply may be a battery, and may be a rechargable battery configured for many cycles of charge and discharge. The battery may be a Lithium based battery, for example a Lithium-Cobalt, a Lithium-Iron-Phosphate, a Lithium Titanate or a Lithium-Polymer battery. The battery may alternatively be a Nickel-metal hydride battery or a Nickel cadmium battery. The battery capacity is preferably selected to allow for multiple uses by the user before requiring recharging. The capacity of the battery is preferably sufficient for a minimum of 20 uses by the user before recharging is required.

As an alternative, the power supply may be another form of charge storage device such as a capacitor. The power supply may require recharging and may have a capacity that allows for the storage of enough energy for one or more smoking experiences; for example, the power supply may have sufficient capacity to allow for the continuous generation of aerosol for a period of around six minutes, corresponding to the typical time taken to smoke a conventional cigarette, or for a period that is a multiple of six minutes. In another example, the power supply may have sufficient capacity to allow for a predetermined number of puffs or discrete activations of the heater assembly.

The aerosol-generating device preferably further comprises control electronics. The control electronics are preferably configured to supply, and regulate, power from the power supply to the at least one heater. Power may be supplied to the heater assembly continuously following activation of the system or may be supplied intermittently, such as on a puff-by-puff basis. The power may be supplied to the heater assembly in the form of pulses of electrical current.

The control electronics may comprise a microprocessor, which may be a programmable microprocessor. The control electronics may comprise further electronic components.

The control electronics are preferably further configured to maintain the temperature of the at least one heater at an operating temperature of between about 80 degrees C. to 270 degrees C. The operation temperature is dependent on the type of aerosol former, if any, used in the aerosol-generating substrate. Preferably, where the aerosol former is propylene glycol, the operation temperature is preferably between about 80 degrees C. and about 90 degrees C. Preferably, where the aerosol former is glycerine, the operation temperature is preferably between about 120 degrees C. and about 200 degrees C.

In addition, the control electronics may be configured to enable flash heating of the aerosol-generating substrate. Flash heating, as used herein, is defined as heating for less than about 3 seconds, more preferably less than about 2 seconds. During flash heating, sufficient energy is transferred to the aerosol-generating substrate to raise the temperature of the aerosol-generating substrate up to 350 degrees C., in order to reach the volatilization temperature as quickly as possible.

The aerosol-generating device may further comprise a temperature sensor adjacent the cavity for receiving the container. The temperature sensor is in communication with the control electronics to enable the control electronics to maintain the temperature at the operating temperature. The temperature sensor may be a thermocouple, or alternatively the at least one heater may be used to provide information relating to the temperature. In this alternative, the temperature dependent resistive properties of the at least one heater are known, and are used to determine the temperature of the at least one heater in a manner known to the skilled person.

The aerosol-generating device may comprise a puff detector in communication with the control electronics. The puff detector is preferably configured to detect when a user draws on the aerosol-generating device mouthpiece. The control electronics are preferably further configured to control power to the at least one heating element in dependence on the input from the puff detector.

The aerosol-generating device preferably further comprises a user input, such as a switch or button. This enables the user to turn the device on. The switch or button may initiate the aerosol generation or prepare the control electronics to await input from the puff detector.

In use, the user inserts a container as described herein into the cavity of an aerosol-generating device as described herein. The user then attaches the mouthpiece to the main body of the aerosol-generating device which pierces the capsule with the piercing portion. The user then activates the device by pressing the button. The user then draws on the mouthpiece which draws air into the device through the air inlet, the air then passes through the container entraining the vapourised aerosol-forming substrate into the airflow, and the exits the device through the air outlet in the mouthpiece to be inhaled by the user.

The aerosol-generating device further comprises a housing comprising the cavity and other components. The housing of the aerosol-generating device is preferably elongate, such as an elongate cylinder having a circular cross-section. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. Preferably, the material is light and non-brittle.

Preferably, the aerosol-generating system is portable. The aerosol-generating system may have a size comparable to a conventional cigar or cigarette. The smoking system may have a total length between approximately 30 mm and approximately 150 mm. The smoking system may have an external diameter between approximately 5 mm and approximately 30 mm.

The aerosol-generating device may comprise a further heater. The further heater may be provided in the cavity for receiving a container. The further heater is configured to receive power from the power supply. The further heater may enable the aerosol-generating substrate to reach an operating temperature more quickly.

Any feature in one aspect of the invention may be applied to other aspects of the invention, in any appropriate combination. In particular, method aspects may be applied to apparatus aspects, and vice versa. Furthermore, any, some and/or all features in one aspect can be applied to any, some and/or all features in any other aspect, in any appropriate combination.

It should also be appreciated that particular combinations of the various features described and defined in any aspects of the invention can be implemented and/or supplied and/or used independently.

The invention will be further described, by way of example only, with reference to the accompanying drawings in which.

Figure 1:
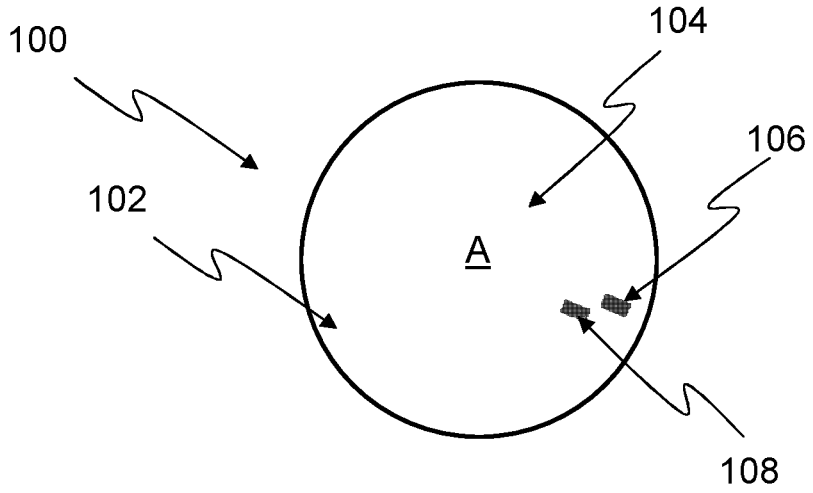
FIG. 1 shows a cap comprising an electrical heater for a container according to the present invention.

FIG. 1 shows a cap 100 for a container for use in an aerosol-generating device. The cap 100 comprises a piercable film 102 and an electrical heating element 104. The electrical heating element comprises two electrical contacts 106 and 108. The electrical contacts are provided at a first and a second radial distance from the centre of the cap. The electrical heating element 104 is arranged having a piercable area A. The area A may be pierced without affecting the operation of the heating element.

The electrical heater is preferably formed by stamping sheet material, the material preferably being stainless steel, copper or brass. The manufacturing process is described in further detail below.

Figure 2:
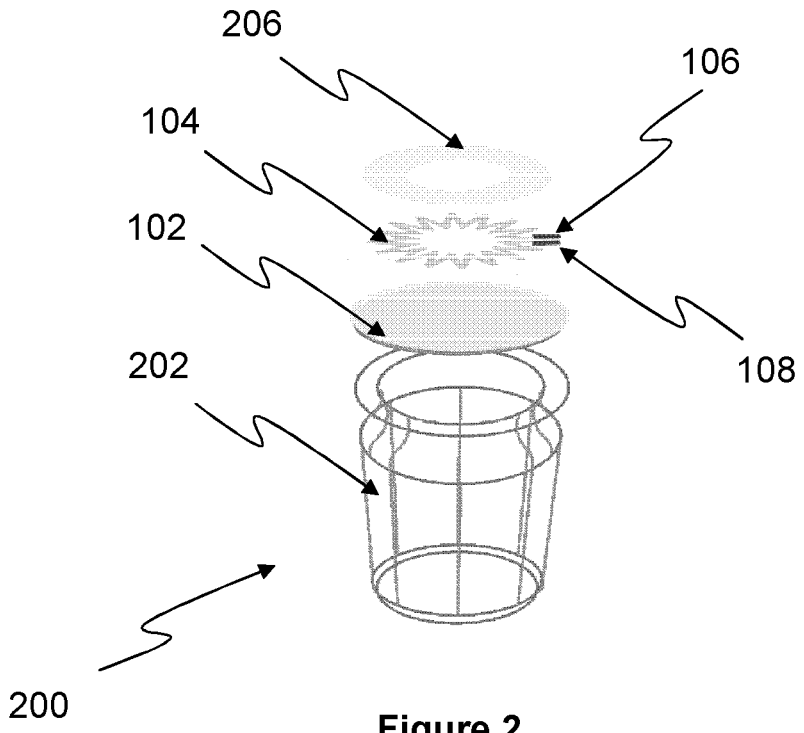
FIG. 2 shows a container according to the present invention comprising a cap as shown in FIG. 1.

FIG. 2 shows an exploded view of a container 200. The container comprises a casing 202 having a thin-walled external side wall and a thin-walled base. The cap 100 is provided at the open end of the casing 202 to forma sealed container for use in an aerosol-generating device. Before the lid is sealed to the lip of the casing 202, the casing of the container is filled with an aerosol-forming substrate (not shown). Approximately 250 mg of aerosol-forming substrate is provided within the container. The aerosol-forming substrate comprises a nicotine containing material, such as tobacco, and an aerosol-former. The aerosol-former is glycerine that provides a good mouth feel for the user; it has also been found that glycerine produces a suitably small aerosol droplet diameter as compared to other aerosol-formers.

Figure 3:
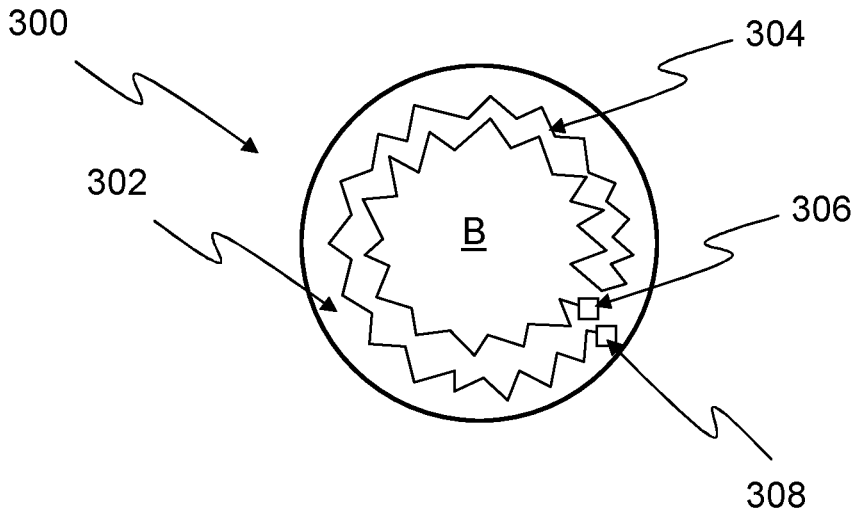
FIG. 3 shows a further embodiment of a cap comprising an electrical heater for a container according to the present invention.

FIG. 3 shows an alternative cap 300 for use in an aerosol-generating device. The cap 300 again comprises a piercable film 302 and an electrical heating element 304. The electrical heating element comprises two electrical contacts 306 and 308. Again, the electrical contacts are provided at a first and a second radial distance from the centre of the cap. The electrical heating element 304 is arranged having a piercable area B. The area B may be pierced without affecting the operation of the heating element. The embodiment shown in FIG. 3 enables a heating element having a total length greater than that of the embodiment shown in FIG. 1.

Figure 4A:
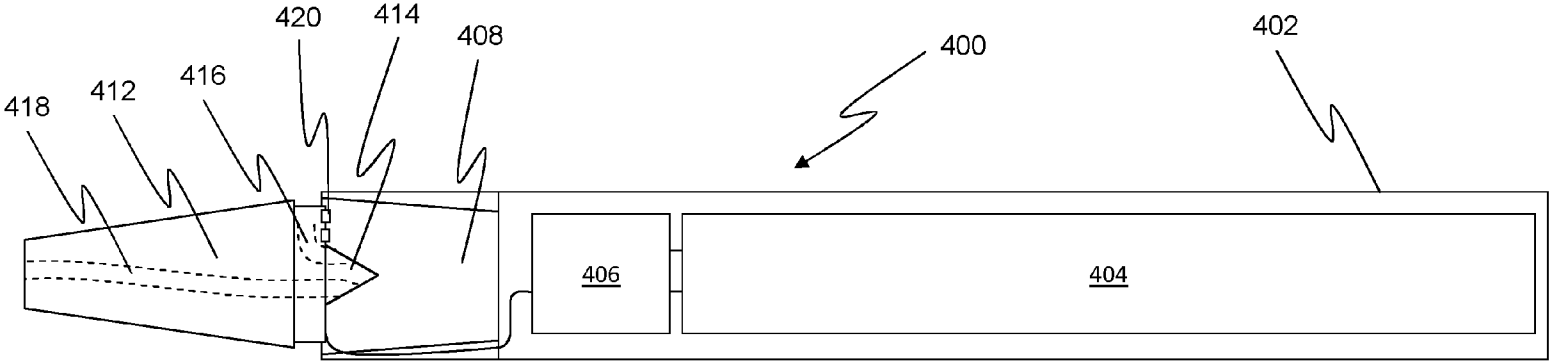
FIG. 4 show an aerosol-generating device according to the present invention with and without a container according to the present invention.
Figure 4B:
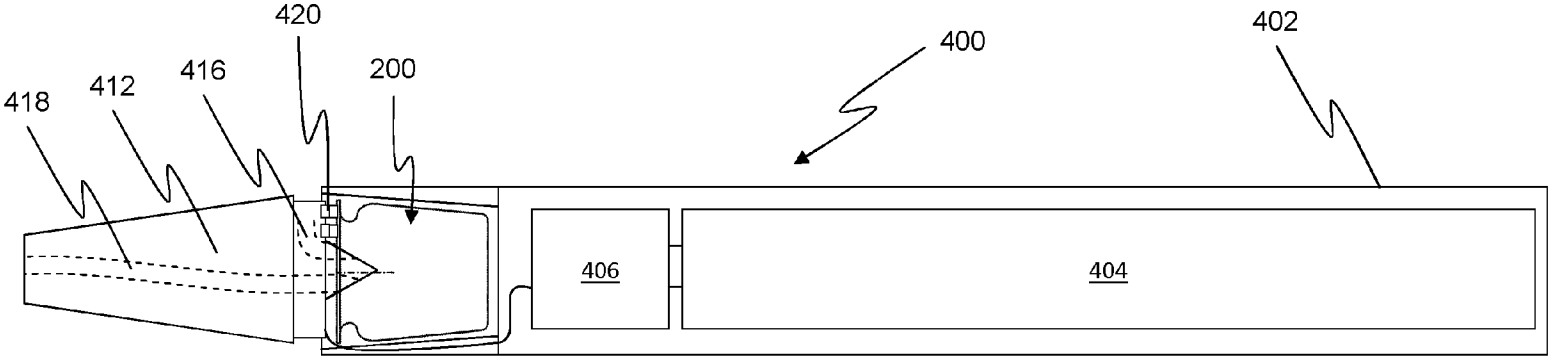
Figure 5A:
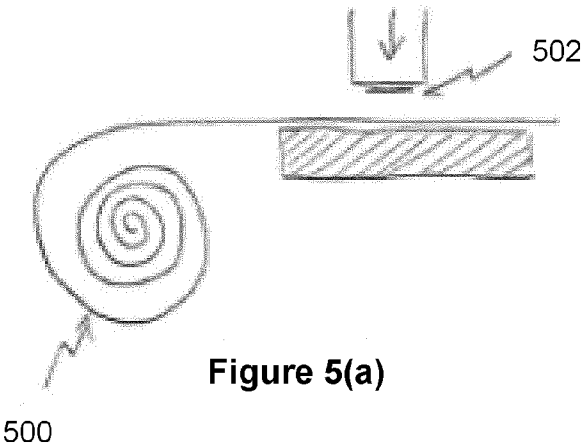
FIG. 5 show a method of manufacturing a container according to the present invention.
Figure 5B:
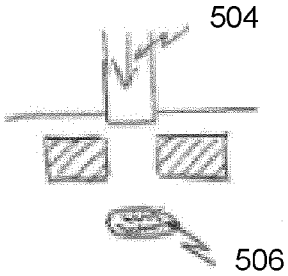
Figure 5C:
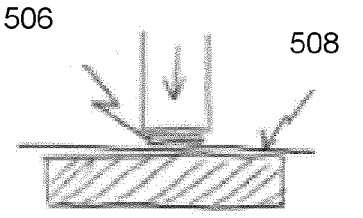
Figure 5D:
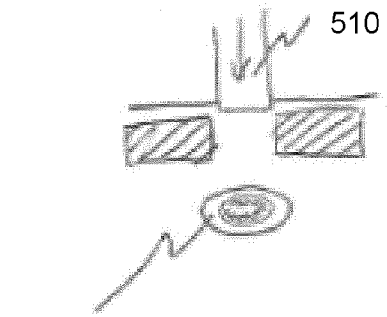
Figure 5E:
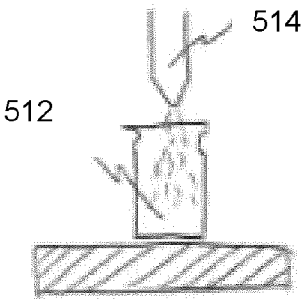
Figure 5F:
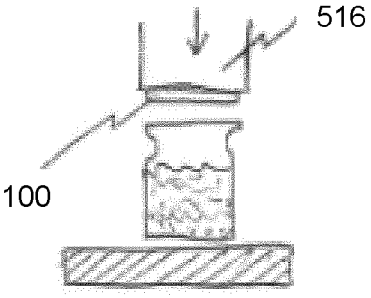

FIG. 4(*a*) shows a cross-sectional view of an aerosol-generating device 400 for use with a container 200 as described above. The aerosol-generating device comprises an outer housing 402, adapted to house: a power supply 404 such as a rechargeable battery; and control circuitry 406. The housing 302 further comprises a cavity 408 configured to receive a container 200. The aerosol-generating device 400 further comprises a mouthpiece 412 attachable to a proximal end of the aerosol-generating device housing 402. The mouthpiece comprises a piercing portion 414, and two airflow conduits, an inlet conduit 416 and an outlet conduit 418. The mouthpiece further comprises electrical contacts 420, in the form of concentric rings, which are described in further detail below.

FIG. 4(*b*) shows a cross-sectional view of an aerosol-generating device 400 comprising a container 200. The container is received in the cavity of the housing. The electrical contacts of the cap of the container 200 connect with the electrical contacts of the mouthpiece when the mouthpiece is coupled to the housing 402. The electrical contacts of the mouthpiece further connect to electrical contacts within the aerosol-generating device which are coupled to the control circuitry 406.

In use, the user inserts the container 200 into the cavity of the aerosol-generating device 400, and then attaches the mouthpiece 412 to the housing 402. By attaching the mouthpiece, the piercing portion 414 pierces the cap of the container, and forms an airflow pathway from the air inlet, through the container to the air outlet. In doing so, the electrical connections are also made. The user then presses a button (not shown) to activate the device. In activating the device, the heater is supplied with power by the control electronics 406 from the power supply 404. When the temperature of the capsule reaches the operating temperature of between about 220 degrees C. and about 240 degrees, the user is informed by means of an indicator (not shown) that the user may then draw on the mouthpiece. When the user draws on the mouthpiece, air enters the air inlet, proceeds through the conduit 416 within the mouthpiece and into the capsule, entrains vapourised aerosol-forming substrate, and then exits the capsule via the outlet conduit 318 in the mouthpiece.

The casing of the container may be manufactured using suitable known techniques, such as deep drawing, and as such is not described in detail herein. However, the manufacturing process of the heating element and the cap is described with reference to FIG. 5.

FIG. 5(*a*) shows a bobbin 500 comprising a web of flexible substrate material. The flexible substrate material is configured to receive a pre-stamped heating element 502. The heating element may be stamped using a suitable die and punch arrangement. Thus in the process step shown in FIG. 5(*a*), a substantially continuous web of flexible substrate material having multiple heating elements is formed.

FIG. 5(*b*) shows the next step in the process. The web of flexible substrate material is cut, using a punch 504 and die, into individual disks 506 each having a heating element. The disks have a diameter substantially equal to the diameter of the cap.

FIG. 5(*c*) shows the individual disks 506 being applied to a substantially continuous web of piercable film 508, such as aluminium. The disks may be applied using adhesive (not shown) or any other suitable means of affixing the disk to the film.

The caps 100 are then formed using a further punch 510 and die as shown in FIG. 5(*d*). The pre-formed casing of the container is then filled with the aerosol-forming substrate 512 using the injector 514, FIG. 5(*e*). As shown in FIG. 5(*f*), finally the cap 100 is sealed to the lip of the container using the applicator 516 to form a sealed container for use in the aerosol-generating device as described above.

Other container designs incorporating a heater in accordance with this disclosure can now be conceived by one of ordinary skill in the art.

The exemplary embodiments described above illustrate but are not limiting. In view of the above discussed exemplary embodiments, other embodiments consistent with the above exemplary embodiments will now be apparent to one of ordinary skill in the art.

The invention claimed is:

1. A container for an electrically heated aerosol-generating device, comprising:

a piercing area configured to be pierced by a piercing element of the electrically heated aerosol-generating device:

a casing; and a cap including the piercing area and a heater, the heater defining a boundary of the piercing area.

2. The container according to claim 1, the heater having an interior edge and an exterior edge, wherein the interior edge of the heater defines the boundary of the piercing area.

3. The container according to claim 1, the heater having an interior edge and an exterior edge, wherein the exterior edge of the heater defines the boundary of the piercing area.

4. The container according to claim 1, wherein the heater is arranged within an annular portion of the cap.

5. The container according to claim 4, wherein the heater has a wave shape and is disposed within the annular portion of the cap, such that a total length of the heater is greater than a circumferential length of the annular portion.

6. The container according to claim 1, wherein the heater comprises two electrical contacts, the first electrical contact disposed at a first distance from an edge of the cap, and the second electrical contact disposed at a second distance from the edge of the cap.

7. The container according to claim 1, wherein the casing has a substantially circular cross-sectional shape.

8. The container according to claim 1, wherein the heater comprises at least one electrically resistive track disposed on a flexible substrate.

9. The container according to claim 8, wherein the cap is a laminate comprising the flexible substrate.

10. The container according to claim 1, further comprising an aerosol-forming substrate comprising nicotine, wherein the aerosol-forming substrate is configured to be accessible when the piercing area has been pierced.

11. An electrically heated aerosol-generating device, comprising:

a power supply;

a cavity configured to receive a container according to claim 1 containing an aerosol-forming substrate;

electrical contacts connected to the power supply and configured to couple the power supply to the heater of the container through the electrical contacts of the container; and means for piercing the piercing area of the container when the container is received in the cavity.

12. The electrically heated aerosol-generating device according to claim 11, the piercing means being a piercing element, the device further comprising:

a mouthpiece comprising the piercing element, at least one air inlet, and at least one air outlet, wherein the piercing means comprises at least one first conduit extending between the at least one air inlet and a distal end of the piercing element, and at least one second conduit extending between a distal end of the piercing element and the at least one air outlet, configured such that when a user draws on the mouthpiece, air flows along an airflow pathway extending from the at least one air inlet, through the at least one first conduit, through a portion of the container, through the at least one second conduit, and exits the at least one outlet.

13. The electrically heated aerosol-generating device according to claim 12, wherein the piercing means is an electrical insulator.

14. A method of manufacturing a container, comprising:

providing a web of flexible substrate material;

applying a plurality of electrically resistive tracks to the web of flexible substrate material;

cutting the web of flexible substrate to form heater elements each comprising an electrically resistive track;

providing a web of pierceable material;

applying the heater elements to the web of pierceable material;

cutting the web of pierceable material to form a plurality of caps;

providing a plurality of containers;

filling each container of the plurality of containers with an aerosol-generating substrate; and sealing each container of the plurality of containers with a cap of the plurality of caps comprising the heater elements.

15. The method according to claim 14, further comprising forming the electrically resistive track by stamping and/or printing.

* * * * *